US010800066B2

(12) United States Patent
Ferrari et al.

(10) Patent No.: US 10,800,066 B2
(45) Date of Patent: Oct. 13, 2020

(54) CUTTING TOOL

(71) Applicant: EMAK S.P.A., Bagnolo in Piano (RE) (IT)

(72) Inventors: Marco Ferrari, Carpi (IT); Gianluca Barbolini, Modena (IT)

(73) Assignee: EMAK S.P.A., Bagnolo in Piano (RE) (IT)

( * ) Notice: Subject to any disclaimer, the term of this patent is extended or adjusted under 35 U.S.C. 154(b) by 0 days.

(21) Appl. No.: 16/308,031

(22) PCT Filed: Jun. 6, 2017

(86) PCT No.: PCT/IB2017/053316

§ 371 (c)(1),
(2) Date: Dec. 7, 2018

(87) PCT Pub. No.: WO2017/216675

PCT Pub. Date: Dec. 21, 2017

(65) Prior Publication Data

US 2019/0202079 A1 Jul. 4, 2019

(30) Foreign Application Priority Data

Jun. 14, 2016 (IT) ..... 102016000060967

(51) Int. Cl.
*B27B 17/12* (2006.01)
*B27B 17/02* (2006.01)

(52) U.S. Cl.
CPC ..... *B27B 17/12* (2013.01); *B27B 17/02* (2013.01)

(58) Field of Classification Search
CPC ..... B27B 17/02; B27B 17/12
See application file for complete search history.

(56) References Cited

U.S. PATENT DOCUMENTS

2010/0043234 A1 2/2010 Pellenc
2018/0052034 A1* 2/2018 Ellwein ..... F01M 11/061

FOREIGN PATENT DOCUMENTS

EP 0076002 A2 4/1983
EP 1961529 A1 8/2008
EP 2641711 A1 9/2013
JP 2002021033 A * 1/2002

* cited by examiner

*Primary Examiner* — Stephen Choi
(74) *Attorney, Agent, or Firm* — Volpe and Koenig, P.C.

(57) ABSTRACT

A cutting tool includes: a loop-wound chain wound about at least a drive crown activated in rotation by a motor, a lubricating circuit of the chain provided with a tank of lubricating fluid, a pump drawn by the motor and having an aspirating conduit of the fluid provided with an aspirating mouth located internally of the tank, and a delivery conduit provided with an outlet mouth located in proximity of the chain, a sensor able to detect the lubricating fluid in the lubricating circuit.

6 Claims, 4 Drawing Sheets

CUTTING TOOL

TECHNICAL FIELD

The present invention relates to a cutting tool.

In particular the invention relates to a cutting tool provided with a cutting chain and a lubricating circuit of the cutting chain.

PRIOR ART

As is known, some cutting tools, such as for example chainsaws, comprise a loop-wound chain wound about at least a drive crown activated in rotation by a motor.

By way of example, a chainsaw comprises a casing internally of which a motor is housed, mechanically connected, for example, by means of a clutch, to a drive crown about which a chain is partially wound.

The chainsaw further comprises a guide bar which projects from the casing and having a perimeter about which the chain is wound.

In particular the bar comprises a first end associated to the casing and proximal to the drive crown and a second free end which projects from the casing and to which a is associated, which driven crown supports the chain. By activating the motor, the drive crown rotates, drawing the chain which can exert the cutting action due to cutting profiles fixed on the chain.

In order to enable correct activating of the chain, and therefore a correct functioning of the tool, and to avoid overheating thereof, it is necessary to provide lubrication of the chain by using a lubricating fluid, for example oil.

The known tools comprise a lubricating circuit of the chain provided with a pump having a delivery conduit arranged in proximity of the chain and connected in aspiration to a tank for the lubricating fluid by means of a draught conduit.

The lubricating pump can be manual or activated by the motor so as to enable a continuous lubrication of the chain during use. In particular, the supply of the lubricating fluid is interrupted substantially when the level of the liquid in the tank (or the quantity of liquid in the tank) reaches a minimum value below which the aspirating conduit is no longer able to draw the liquid from the tank.

Further, during use of the tool, in particular in the case of portable tools grippable by an operator such as for example a chainsaw, the lubricating fluid displaces internally of the tank and therefore the aspirating conduit is not always able to draw the lubricating fluid.

In the absence of lubrication the tool begins malfunctioning and the chain and/or the guide bar overheat.

Therefore it is advisable to maintain the level of the oil in the upper tank with respect to a minimum level.

A necessity that has been noticed in these known tools, especially when the pump is activated by the motor is, therefore, to guarantee that the user is alerted when the quantity of oil drops below the minimum level so as to proceed to topping it up in good time.

An aim of the present invention is to meet this necessity in the prior art, with solution that is simple, rational and functional.

The aims are attained by the characteristics of the invention as reported in the independent claim. The dependent claims delineate preferred and/or particularly advantageous aspects of the invention.

DESCRIPTION OF THE INVENTION

The present invention relates to a cutting tool, comprising: a loop-wound chain wound about at least a drive crown activated in rotation by a motor, a lubricating circuit of the chain provided with a tank of lubricating fluid, a pump drawn by the motor and having an aspirating conduit of the fluid provided with an aspirating mouth located internally of the tank, and a delivery conduit provided with an outlet mouth located in proximity of the chain.

In the invention, the tool comprises a sensor for detecting the lubricating fluid in the lubricating circuit.

With this solution, the sensor enables verifying and signalling to the user, in good time, when the quantity of lubricating fluid in the lubricating circuit falls below a minimum level allowed, avoiding onset of malfunctioning of the cutting tool.

In an aspect of the invention, the tool can comprise an electronic control unit operatively connected to the sensor and configured so as carry out a detection procedure of the lubricating fluid which comprises steps of: receiving an input signal from the sensor; determining whether the quantity of lubricating fluid in the lubricating circuit is less than or equal to a minimum level thereof as a function of the input signal.

With this solution, the detecting of the lubricating fluid can be done automatically, rapidly and independently of the user's attention to it.

In a further aspect of the invention, the electronic control unit can be configured for repeating the detection procedure of the fluid for a plurality of times; generating an output signal if the determining that the quantity of lubricating fluid in the lubricating circuit is less than or equal to a minimum level thereof recurs for a predetermined number of times with respect to the plurality.

In this way it is possible to obtain accurate measurements from the sensor so as to reduce or avoid false positives or extemporaneous detections.

In a further aspect of the invention, the tool can be provided with an interface connected to the electronic control unit and configured for: receiving the output signal of the electronic control unit, and generating an alarm signal perceptible (visible or audible) by a user.

In this way, the user can immediately be informed of the fact that the level of the liquid in the lubricating circuit has fallen below a minimum level and can proceed to top up the tank in good time.

Further, the sensor can be an optical sensor fixed inside the tank.

In this way it is possible to carry out a direct detection of the presence of the lubricating fluid in the tank until the fluid falls below the level at which the sensor is arranged.

In a further aspect of the invention, the optical sensor is arranged substantially coaxial to the aspirating mouth of the aspirating conduit.

In this way, the presence of liquid in proximity of the aspirating mouth can be detected so as to verify the aspirating capacity of the pump independently of the presence of fluid in other parts of the lubricating circuit.

In a further aspect of the invention, the sensor can be an extensometer sensor fixed inside the tank.

In this way an indirect detection of the presence of lubricating fluid in the circuit can be made, which takes into consideration the different response to stresses in the tank as a function of the presence (or absence) of lubricating fluid internally thereof, so that the detection is totally independent of the position of the tool.

In a further aspect of the invention, the sensor can be a flow rate sensor arranged in the aspirating conduit.

In this way an accurate detecting of the presence of lubricating fluid in the circuit can be made, with an immediate signalling if the lubricating fluid is in a low or absent quantity.

In a further embodiment the sensor can be a thermal sensor.

In this way an indirect detection can be made of the presence of lubricating fluid in the lubricating circuit i.e. by the variation in temperature caused by the lack of lubrication of the cutting chain for signalling the scarcity or absence of the lubricating fluid in the lubricating circuit in good time.

The invention further discloses a method for detecting the lubricating fluid in a lubricating circuit of a cutting tool according to any of the preceding aspects, which includes steps of carrying out a detection procedure comprising steps of: generating an input signal by means of a sensor for detecting a lubricating fluid in a lubricating circuit of a chain of the cutting tool, and determining whether the quantity of lubricating fluid in the lubricating circuit is less than (or equal to) a minimum level thereof as a function of the input signal.

In this way a method is disclosed that enables detecting the absence of the lubricating fluid in the lubricating circuit and advising the user in good time. In a further aspect of the invention, the method can comprise steps of: repeating the detection procedure of the lubricating fluid for a plurality of times; and generating the alarm signal if the determination that the quantity of lubricating fluid in the lubricating circuit is less than or equal to a minimum level thereof recurs for a predetermined number of times with respect to the plurality.

In this way it is possible to verify the sensor detections so as to avoid activating readings of false positives or extemporaneous detections.

BRIEF DESCRIPTION OF THE DRAWINGS

Further characteristics and advantages of the invention will emerge from a reading of the following description, provided by way of non-limiting example with the aid of the figures illustrated in the appended tables of drawings.

BEST WAY OF CARRYING OUT THE INVENTION

Figure 1:
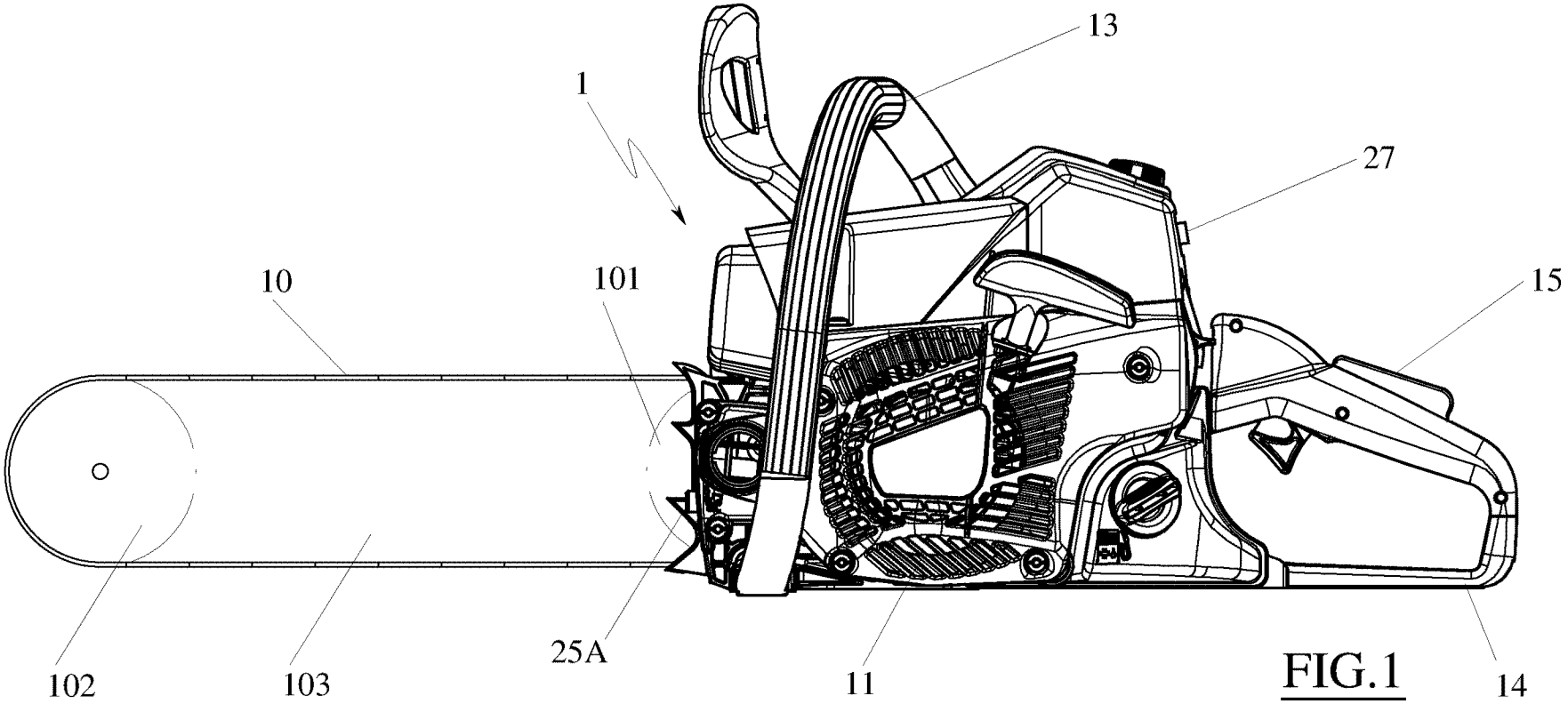
FIG. 1 is a lateral view of the cutting tool according to a first embodiment.
Figure 2:
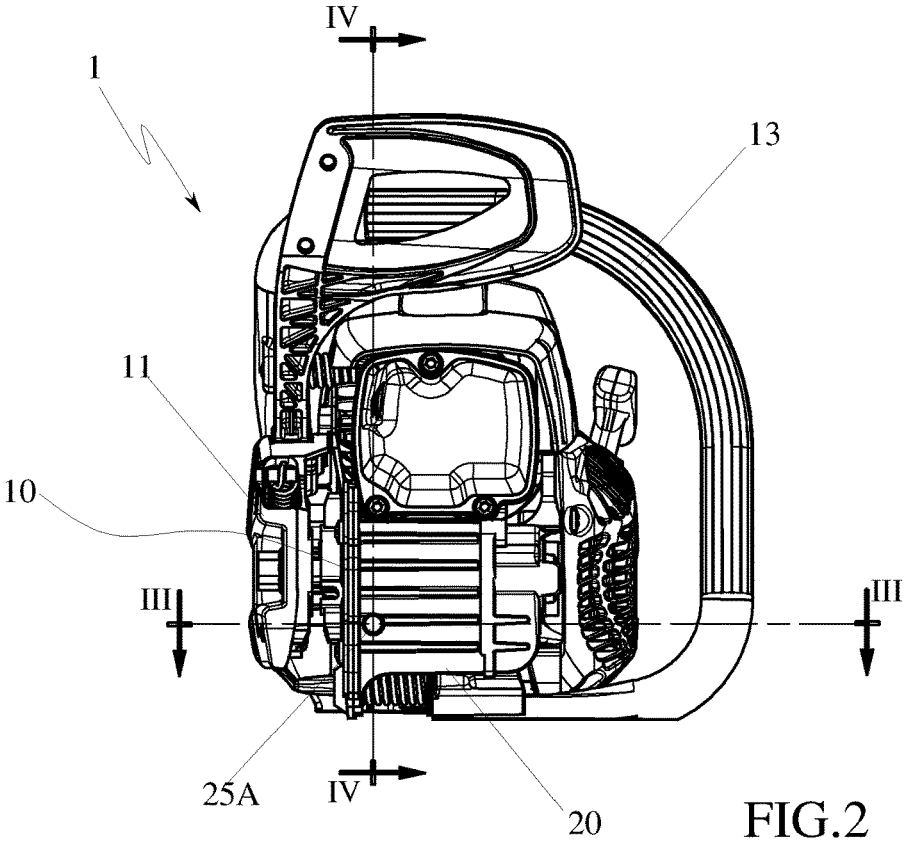
FIG. 2 is a front view of the cutting tool according to a first embodiment.
Figure 3:
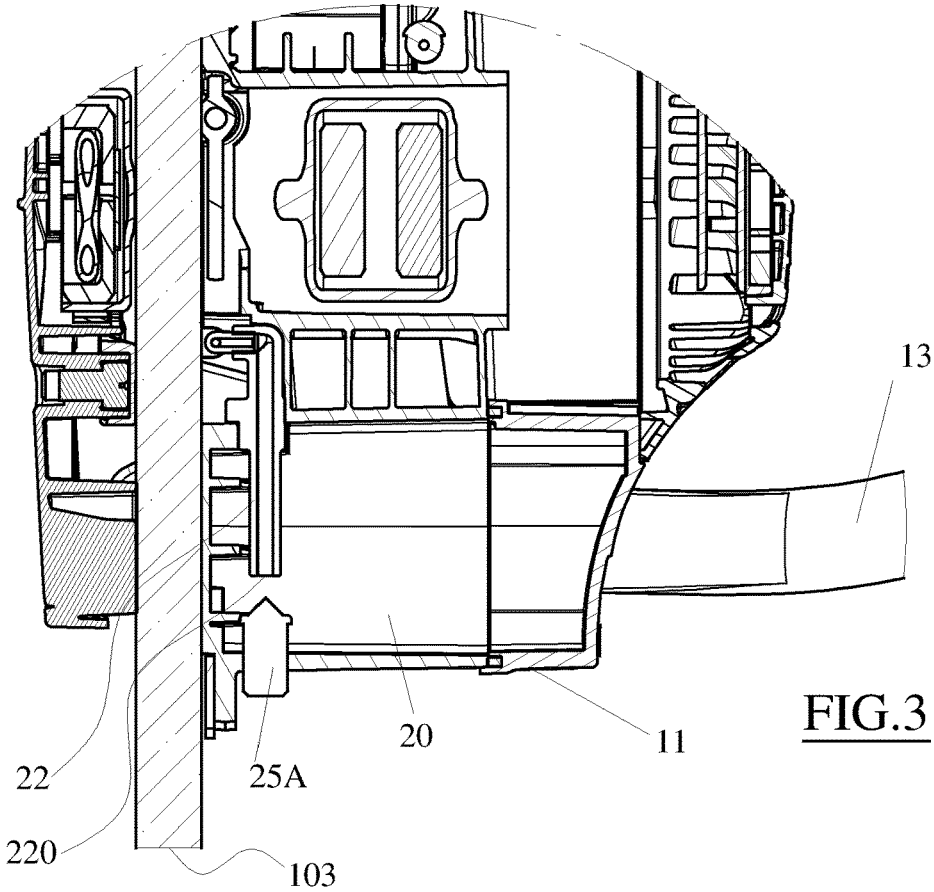
FIG. 3 is a larger-scale detail of section III-III of FIG. 2.
Figure 4:
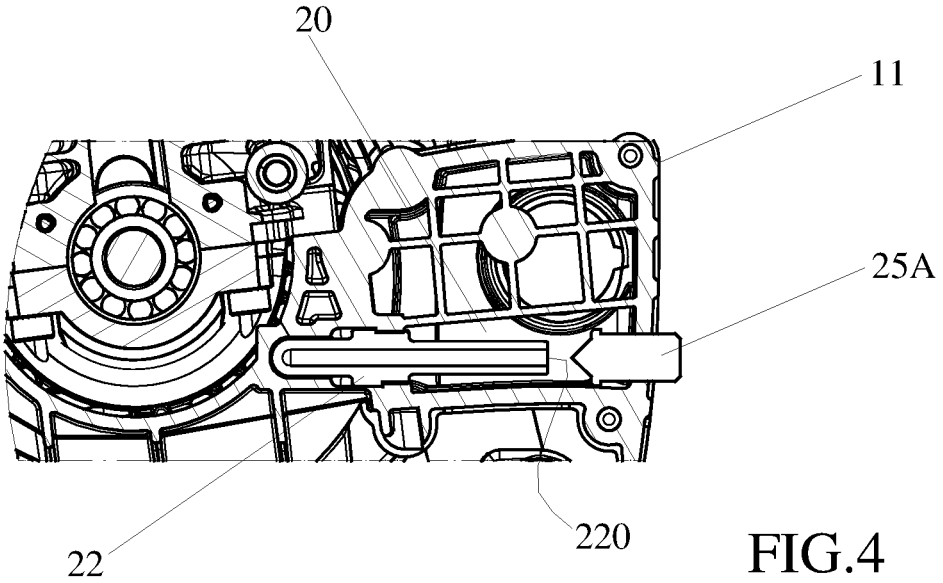
FIG. 4 is a larger-scale detail of section IV-IV of FIG. 3.
Figure 5:
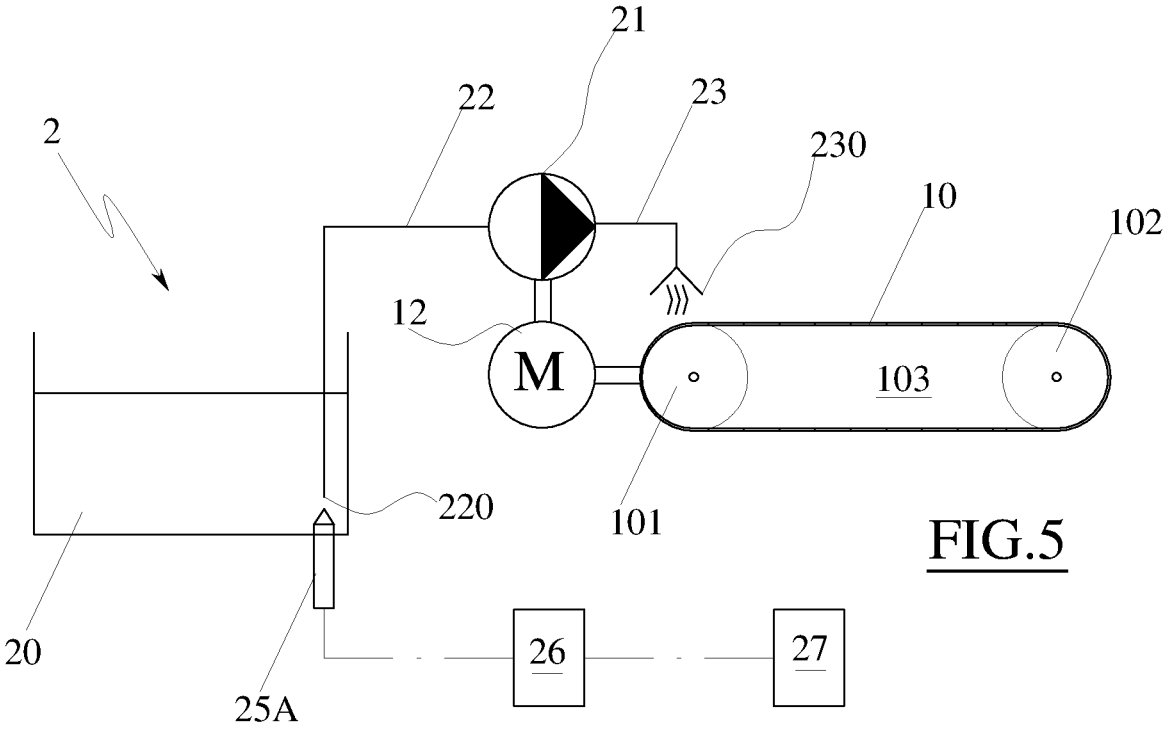
FIG. 5 is a diagram of the cutting tool according to a first embodiment.

With particular reference to the figures, 1 denotes in its entirety a cutting tool, for example a chainsaw, which tool 1 is provided with a cutting chain 10 to which cutting profiles are fixed.

The tool 1 comprises a casing 11, internally of which an activating motor 12 of the chain 10 is housed, for example an internal combustion engine or an electric motor.

The casing 11 has a substantially irregular shape and comprises a front wall, from which the chain 10 projects, as will be more fully described in the following, and an opposite rear wall to which a manoeuvring grip 14 is associated.

In the embodiment illustrated in the figures, the tool 1 comprises a gripping handle 13, substantially C-shaped and fixed at the ends thereof respectively to an upper portion and a lower portion of the casing 11, in such a way that the intermediate part is substantially flanked to a lateral wall of the casing 11. The manoeuvring grip 14 projects from the rear wall of the casing 11 and is provided with command organs 15.

In particular, the chain 10 is loop-wound, for example having a substantially elliptical shape, and is wound about at least a drive crown 101 housed in the casing 11 and activatable in rotation by a motor 12.

The drive crown 101 is connected to the motor 12, for example by means of a clutch.

In the illustrated example, the chain 10 is wound about the drive crown 101 and a driven crown 102 so as substantially to define an ellipse the foci of which are represented by the centres of the drive crown 101 and the driven crown 102.

In the illustrated example, the tool 1 comprises a guide bar 103 of the chain 10 associated to the casing 11 and arranged so as to distance the drive crown 101 and the driven crown 102 from one another.

In particular the guide bar 103 is substantially conformed as an elongate plate along a longitudinal direction thereof and provided with an end constrained to the casing 11, in proximity of the drive crown 101 and a free end projecting from the casing 11 to which the driven crown is rotatably associated 102.

In the illustrated example, the guide bar 103 projects from the front wall of the casing 11, i.e. from the wall opposite the manoeuvring grip 14.

The guide bar 103 advantageously comprises a longitudinal groove realised along both the opposite longitudinal edges of the guide bar, which defines a sliding guide for the chain 10.

The tool 1 further comprises a lubricating circuit 2 of the chain 10.

The lubricating circuit 2 comprises a tank 20 of lubricating fluid, for example oil, housed in the casing 11 and communicating with the outside of the casing 11 by means of an opening occluded by a cap.

In the embodiment shown in the figures, the tank 20 is arranged in a front portion of the casing 11 i.e. close to the drive crown 101 and at the constrained end of the guide bar 103.

The lubricating circuit 2 comprises a pump 21, drawn by the motor and housed in the casing 11.

The pump 21 is mechanically connected to the motor 12 so as to lubricate the chain 10 at the same time as the activating of the chain 10.

The pump 21 is preferably connected to the motor by means of a clutch so as to be activated by the motor only when the drive crown 101 is activated in rotation by the motor 12.

The pump 21 is connected to the tank 20 by means of an aspirating conduit 22 of the fluid, provided with an aspirating mouth 220 located internally of the tank 20.

In particular, in the embodiment shown in the figures, the aspirating mouth 220 faces towards the (internal face of the) front wall of the casing 11, i.e. from the wall of the casing 11 from which the guide bar 103 projects.

Further, the pump 21 comprises a delivery conduit 23 provided with an outlet mouth 230 located in proximity of the chain 10.

The tool 1 further comprises a sensor 25A, 25B, 25D, 25D able to detect the lubricating fluid in the lubricating circuit 2, i.e. able to detect the presence (or absence) of the lubricating fluid in the lubricating circuit 2.

For example, the sensor 25A, 25B, 25C, 25D is able to measure a value of a parameter indicative of the quantity of lubricating fluid in the lubricating circuit 2, as will be more fully described in the following.

Further, the tool 1 comprises an electronic control unit 26 operatively connected to the sensor 25A, 25B, 25C, 25D, and configured for determining whether the quantity of lubricating fluid in the lubricating circuit 2 is less than or equal to a minimum level thereof on the basis of the measuring carried out by the sensor 25A, 25B, 25C, 25D.

In particular, the electronic control unit 26 is programmed so as carry out a detection procedure of the lubricating fluid in the lubricating circuit 2 which comprises steps of:

- receiving an input signal from the sensor 25A, 25B, 25C, 25D;
- determining whether the quantity of lubricating fluid in the lubricating circuit 2 is less than (or equal to) a minimum level thereof as a function of the input signal.

In greater detail, the detection procedure of the lubricating fluid in the lubricating circuit 2 comprises steps of:

- receiving an input signal from the sensor 25A, 25A, 25C, 25D; representing the measured value of the parameter indicative of the quantity of lubricating fluid in the lubricating circuit 2;
- comparing the measured value with a predetermined threshold value of the parameter;
- identifying that the quantity of lubricating fluid in the lubricating circuit 2 is less than (or equal to) a minimum level thereof if the value measured differs (for example significantly) from the threshold value, for example it is higher or lower than the threshold value.

The electronic control unit 26 advantageously comprises a memory in which the predetermined threshold value and other parameters useful for the detecting of the lubricating fluid in the lubricating circuit 2 are preloaded.

The tool 1 further comprises an interface 27 operatively connected to the electronic control unit 26 and configured for receiving the output signal of the electronic control unit 26 and generating an alarm signal directly perceptible by a user for indicating that the quantity of the lubricating fluid in the lubricating circuit 2 is less than (or equal to) the minimum level thereof.

According to the embodiments illustrated in the figures, the interface 27 is advantageously configured for emitting a visual signal to the user.

For example, the interface 27 comprises at least a LED fixed to the casing 11 and visible from externally of the casing 11.

The interface 27 is advantageously fixed to a rear wall of the casing 11, i.e. to the wall from which the manoeuvring grip 14 projects (i.e. in the opposite position with respect to the chain 10) so as to be clearly visible to the user during the use of the tool 1.

In a first embodiment, shown in figures from 1 to 5, the lubricating circuit comprises an optical sensor 25A fixed inside the tank 20.

In the illustrated example, the optical sensor 25A is substantially conformed as a cylindrical shank housed in an appropriate through-hole fashioned in the tank 20 and, for example, comprises a first cylindrical portion which projects internally of the tank 20, and a second cylindrical portion that projects externally of the tank 20, for example externally of the casing 11.

In particular, the second cylindrical portion projects from the optical sensor 25A externally of the front wall of the casing 11, i.e. from the wall the guide bar 103 projects from.

The optical sensor 25A is advantageously fixed to the tank 20 in a position such as to detect the presence of the lubricating fluid substantially at a level equal to the level at which the aspirating mouth 220 of the aspirating conduit 22 is located.

Further, the optical sensor 25A, for example the first cylindrical portion thereof, is arranged in the tank 20 at the same height as the aspirating mouth 220.

In particular the first cylindrical portion of the optical sensor 25A is arranged substantially coaxial to the aspirating mouth 220.

The optical sensor 25A is advantageously arranged internally of the tank 20 in a position proximal to the aspirating mouth 220, for example, it is arranged at a distance from the aspirating mouth 220 comprised between 1 and 20 mm, for example 10 mm.

In this first embodiment, the optical sensor 25A is, for example, provided with a first and a second photocell fixed to the free end of the first cylindrical portion of the optical sensor 25A and connected to an electrical circuit, i.e. to the end of the optical sensor 25A inserted in the tank 20, and are incorporated in an optically transparent material.

For example, the first photocell is able to emit a light beam that is received by the second photocell of the optical sensor 25A.

The intensity of the light beam received from the second photocell varies, for example diminishes, when the optical sensor 25A and in particular the end of the optical sensor 25A inserted in the tank 20 is immersed in the lubricating fluid due to the diffusion of the light beam in the lubricating fluid itself with respect to when the optical sensor 25A is immersed in air.

In this first embodiment, for example, the optical sensor 25A is able to detect when the quantity of lubricating fluid in the tank 20 falls below the minimum level as when the optical sensor 25A is immersed in air, the electrical circuit opens (or closes) and transmits to the electronic control unit 26 an input signal representing the fact that the quantity of lubricating fluid in the tank 20 has fallen below the minimum level.

In this first embodiment, for example, the electronic control unit 26 is configured for:

- receiving the input signal from the optical sensor 25A, and
- identifying that the quantity of lubricating fluid in the lubricating circuit 2 is less than the minimum level thereof as a function of the input signal received. In this case, the electronic control unit 26 is configured for:
- repeating the detection procedure of the fluid for a plurality of times;
- and generating an output signal if the identification that the quantity of lubricating fluid in the lubricating circuit 2 is less than or equal to a minimum level thereof recurs for a predetermined number of times, for example greater than 1, during the course of the repetitions.

In this case, the interface 27 is able to receive the output signal generated by the electronic control unit 26 and switch on the LED.

Figure 6:
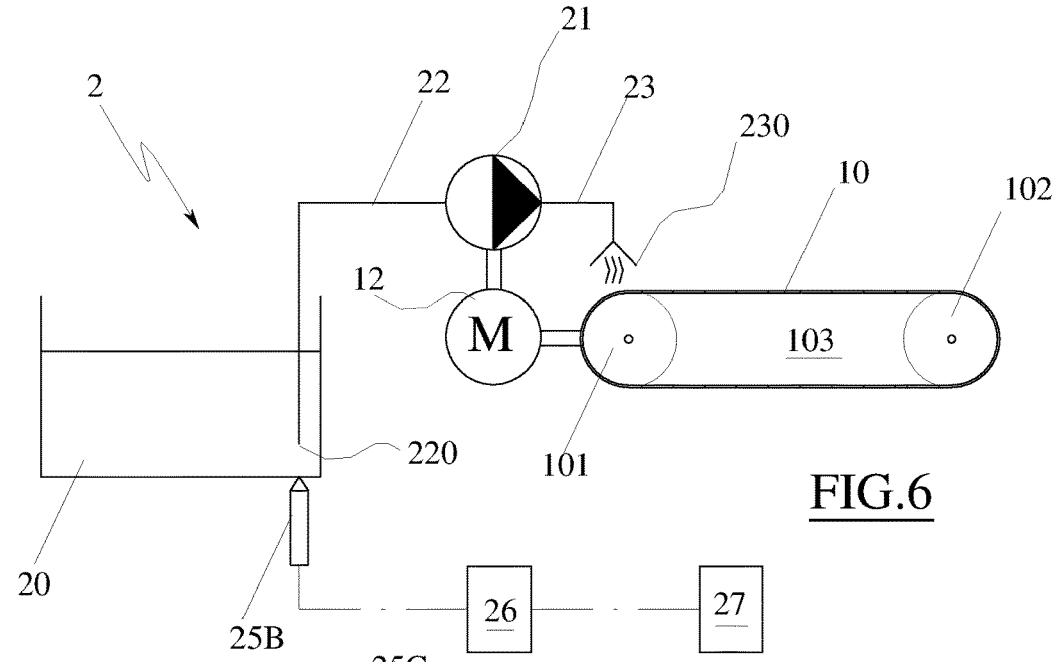
FIG. 6 is a diagram of the cutting tool according to a second embodiment.

In a second embodiment, illustrated schematically in FIG. 6, the tool 1 comprises an extensometer sensor 25B associated to the tank 20 and configured so as to detect the vibrations of the tank 20 during the use of the tool 1.

In fact the tank 20, during the functioning of the tool 1, vibrates differently as a function of the quantity of lubricating fluid present in the tank 20, for example the tank 20 tends to vibrate with greater frequencies if it is empty or almost empty and to vibrate with smaller frequencies if it is completely full or nearly full.

For example, in this second embodiment the extensometer sensor 25B is of the Wheatstone bridge type and is configured for measuring the vibration frequency of the tank 20.

The extensometer sensor 25B is advantageously arranged internally of the tank 20 in a position such as to detect the presence of the lubricating fluid substantially at the aspirating mouth 220 of the aspirating conduit 22.

The extensometer sensor 25B is in particular arranged internally of the tank 20 in a position proximal to the aspirating mouth 220.

In this second embodiment, for example, the electronic control unit 26 is configured for: receiving the input signal from the optical sensor 25B, representing the value of the measured frequency;

determining whether the measured value is equal to or greater than a predetermined threshold frequency value;

identifying that the quantity of lubricating fluid in the lubricating circuit 2 is less than (or equal to) the minimum level thereof if the value measured is greater than the threshold value.

The electronic control unit 26 is configured for:

repeating the detection procedure of the absence of fluid for a plurality of times; and generating an output signal if the identification that the quantity of lubricating fluid in the lubricating circuit 2 is less than (or equal to) a minimum level thereof recurs for a predetermined number of times during the repetitions.

In this case the interface 27 is able to receive the output signal of the electronic control unit 26 and switch on the LED.

Figure 7:
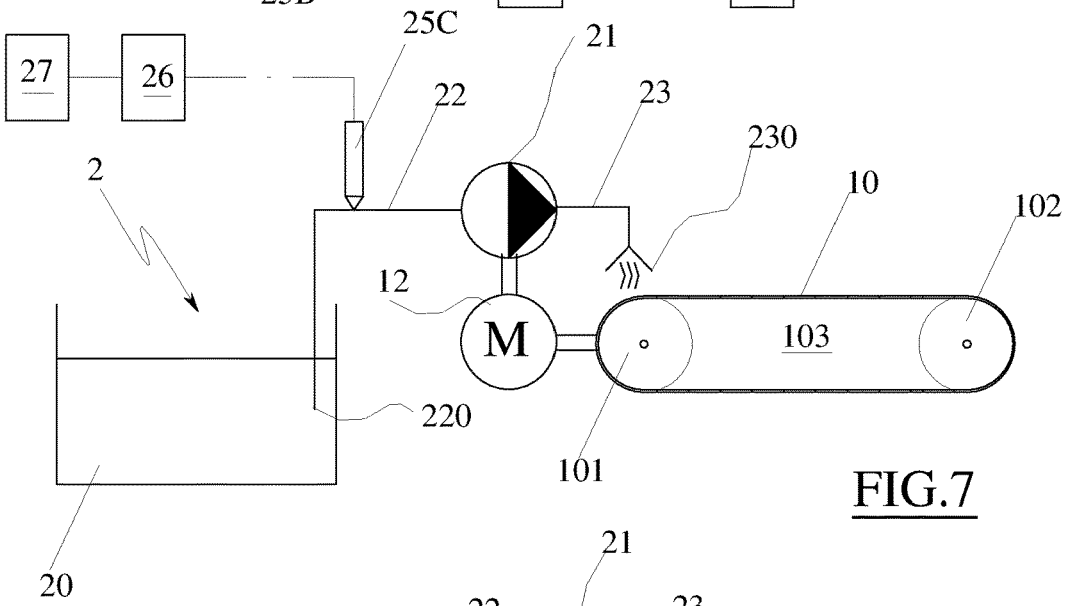
FIG. 7 is a diagram of the cutting tool according to a third embodiment.

In a third embodiment, schematically illustrated in FIG. 7, the tool 1 comprises a flow rate sensor 25C fixed to the aspirating conduit 22 and able to measure a value of the flow rate of the lubricating fluid in the aspirating conduit 22.

In this third embodiment, for example, the electronic control unit 26 is configured for receiving the input signal from the flow rate sensor 25C, representing the value of the flow rate measured;

determining whether the measured value is equal to or less than a predetermined threshold flow rate value;

identifying that the quantity of lubricating fluid in the lubricating circuit 2 is less than a minimum level thereof if the value measured is less than (or equal to) the threshold value.

Further, the electronic control unit 26 is configured for:

repeating the detection procedure of the fluid for a plurality of times;

generating an output signal if the determining that the quantity of lubricating fluid in the lubricating circuit 2 is less than a minimum level thereof recurs for a predetermined number of times during the repetitions.

In this case the interface 27 is able to receive the output signal generated by the electronic control unit 26 and switch on the LED.

Figure 8:
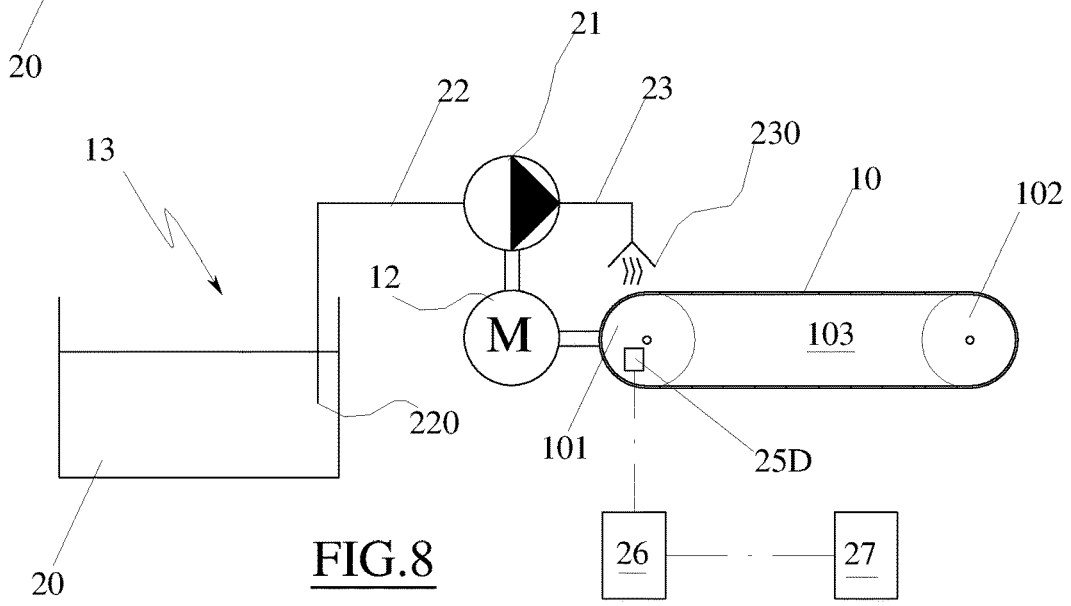
FIG. 8 is a diagram of the cutting tool according to a fourth embodiment.

In a fourth embodiment, schematically illustrated in FIG. 8, the tool 1 comprises a thermal sensor 25D.

The thermal sensor 25D is able to measure the temperature of the tool 1, for example the chain 10.

For example, in the illustrated embodiment, the thermal sensor 25D is associated to the guide bar 103 and is able to measure the temperature of the guide bar 103.

In this fourth embodiment, for example, the electronic control unit 26 is configured for receiving the input signal from the thermal sensor 25D, representing the temperature value measured;

determining whether the measured value is equal to or greater than a predetermined threshold temperature value;

identifying that the quantity of lubricating fluid in the lubricating circuit 2 is less than a minimum level thereof if the value measured is greater than (or equal to) the threshold value.

Further, the electronic control unit 26 is configured for:

repeating the detection procedure of the fluid for a plurality of times;

generating an output signal if the determining that the quantity of lubricating fluid in the lubricating circuit 2 is less than a minimum level thereof recurs for a predetermined number of times during the repetitions.

In this case the interface 27 is able to receive the output signal generated by the electronic control unit 26 and switch on the LED.

The invention as it is conceived is susceptible to numerous modifications, all falling within the scope of the inventive concept.

Further, all the details can be replaced with other technically-equivalent elements.

In practice the materials used, as well as the contingent shapes and dimensions, can be any according to requirements, without forsaking the scope of protection of the following claims.

The invention claimed is:

1. A cutting tool (1) comprising:

a loop-wound chain (10) wound about at least a drive crown (101) activated in rotation by a motor (12), a lubricating circuit (2) of the chain (10) provided with a tank (20) of lubricating fluid, a pump (21) drawn by the motor (12) and having an aspirating conduit (22) of the fluid provided with an aspirating mouth (220) located internally of the tank (20), and a delivery conduit (23) provided with an outlet mouth (230) located in proximity of the chain (10), a sensor (25A, 256, 25C, 250) able to detect the lubricating fluid in the lubricating circuit (2), wherein the sensor is an optical sensor (25A) having a cylindrical portion fixed inside the tank (20) and arranged coaxial to the aspirating mouth (220) of the aspirating conduit (22).

2. The tool (1) of claim 1, further comprising an electronic control unit (26) operatively connected to the sensor (25A, 256, 25C, 250) and configured so as carry out a detection procedure of the lubricating fluid which comprises steps of:

receiving an input signal from the sensor (25A, 256, 25C, 250);

determining whether the quantity of lubricating fluid in the lubricating circuit (2) is less than or equal to a minimum level thereof as a function of the input signal.

3. The tool (1) of claim 2, wherein the electronic control unit (26) is configured for:

repeating the detection procedure of the fluid for a plurality of times; and generating an output signal if the determining that the quantity of lubricating fluid in the lubricating circuit (2)

is less than or equal to a minimum level thereof recurs for a predetermined number of times.

4. The tool (1) of claim 3, further comprising an interface (27) connected to the electronic control unit (26) and configured for:

receiving the output signal of the electronic control unit (26) and generating an alarm signal perceptible by a user.

5. A method for detecting a lubricating fluid in a lubricating circuit (2) of a cutting tool (1) according to claim 1, the method comprising the steps of:

carrying out a detection procedure comprising steps of:

generating an input signal by means of the sensor (25A, 258, 25C, 25D) for detecting a lubricating fluid in a lubricating circuit (2) of the chain (10) of the cutting tool (1), and determining whether the quantity of lubricating fluid in the lubricating circuit (2) is less than or equal to a minimum level thereof as a function of the input signal;

generating an alarm signal directly perceptible by a user when it is determined that the quantity of the lubricating fluid in the lubricating circuit (2) is less than or equal to a minimum level thereof.

6. The method of claim 5, further comprising the steps of:

repeating the detection procedure of the lubricating fluid for a plurality of times;

generating the alarm signal if the determination that the quantity of lubricating fluid in the lubricating circuit (2) is less than or equal to a minimum level thereof recurs for a predetermined number of times.

* * * * *